US008203458B2

(12) United States Patent
Kaneblei et al.

(10) Patent No.: US 8,203,458 B2
(45) Date of Patent: Jun. 19, 2012

(54) SAFETY HELMET WITH GAS-MEASURING DEVICE

(75) Inventors: Ingo Kaneblei, Hernburg (DE); Sandra Bruegmann, Kiel (DE); Andreas Nauber, Stockelsdorf (DE)

(73) Assignee: Dräger Safety AG & Co. KGaA, Lüfeck (DE)

( * ) Notice: Subject to any disclaimer, the term of this patent is extended or adjusted under 35 U.S.C. 154(b) by 409 days.

(21) Appl. No.: 12/489,666

(22) Filed: Jun. 23, 2009

(65) Prior Publication Data

US 2009/0322546 A1 Dec. 31, 2009

(30) Foreign Application Priority Data

Jun. 28, 2008 (DE) ..... 10 2008 030 790

(51) Int. Cl.
*G08B 17/10* (2006.01)

(52) U.S. Cl. ..... 340/632; 340/628; 2/410; 2/5

(58) Field of Classification Search ..... 340/628, 340/632; 2/410, 5, 424
See application file for complete search history.

(56) References Cited

U.S. PATENT DOCUMENTS

| | | | | |
|---|---|---|---|---|
| 4,263,588 | A * | 4/1981 | Gautier | 340/632 |
| 5,659,296 | A * | 8/1997 | Debe et al. | 340/632 |
| 6,075,445 | A * | 6/2000 | McLoughlin et al. | 340/586 |
| 6,826,783 | B1 * | 12/2004 | Grove et al. | 2/424 |
| 7,019,652 | B2 * | 3/2006 | Richardson | 340/573.1 |
| 8,085,144 | B2 * | 12/2011 | Appelt et al. | 340/539.11 |
| 2002/0190866 | A1 * | 12/2002 | Richardson | 340/632 |
| 2006/0125623 | A1 * | 6/2006 | Appelt et al. | 340/521 |
| 2007/0022520 | A1 * | 2/2007 | Grassl et al. | 2/424 |

FOREIGN PATENT DOCUMENTS

| | | |
|---|---|---|
| DE | 198 31 893 C2 | 1/2000 |
| DE | 202004014081 | 1/2005 |
| DE | 102005024507 | 10/2006 |
| DE | 202006013747 | 1/2007 |
| DE | 202007008438 U1 | 10/2007 |
| JP | 2007154365 | 6/2007 |

* cited by examiner

*Primary Examiner* — Eric M Blount
(74) *Attorney, Agent, or Firm* — McGlew and Tuttle, P.C.

(57) ABSTRACT

A safety helmet provides toxic gas monitoring in the field of vision of the helmet user. The safety helmet includes a gas-measuring device of modular design. The safety helmet has a sensor module (5) positioned in the field of vision of the helmet user.

17 Claims, 3 Drawing Sheets

SAFETY HELMET WITH GAS-MEASURING DEVICE

CROSS REFERENCE TO RELATED APPLICATIONS

This application claims the benefit of priority under 35 U.S.C. §119 of German Patent Application DE 10 2008 030 790.4 filed Jun. 28, 2008, the entire contents of which are incorporated herein by reference.

FIELD OF THE INVENTION

The present invention pertains to a safety helmet with a gas-measuring device.

BACKGROUND OF THE INVENTION

Safety helmets are used in the area of firefighting, industry, by rescue teams or in the military. Safety helmets are part of a personal protective gear, which may also include a safety suit, goggles and additional components, such as communications means. Corresponding adapters are present on the safety helmet for attaching additional components in order to enable functional accessories to be attached.

A safety helmet with a circumferential module ring, which has a plurality of plug-in slots located at spaced locations from one another in the longitudinal direction of the module ring, is disclosed in DE 10 2005 024 507 B3. Complementary plug-in elements, with which the functional components can be attached to the safety helmet, are provided for the plug-in slots. The functional accessories comprise, for example, visors, ear muffs, mask adapters, lamps, infrared or video cameras, power supply units, mechanical aids and even communications means.

Safety helmets usually comprise a hard outer shell and a flexible inner lining, which is used to adapt the safety helmet to the different head shapes of the users of safety helmets. A safety helmet of the said type appears, for example, from CH 438 755 A. The inner lining has a support ring, which is in contact with the head of the user of the safety helmet.

Gas-measuring devices, which belong to the protective gear in a toxic gas atmosphere, are attached as mobile devices to pieces of clothing or to a belt by means of a strap. A mobile gas-measuring device with a strap appears, for example, from DE 198 31 893 C2.

SUMMARY OF THE INVENTION

The basic object of the present invention is to improve a safety helmet such that monitoring of toxic gases is made possible in the field of vision of the helmet user without wearing comfort being compromised.

According to the invention a safety helmet is provided in combination with a gas-measuring device. The safety helmet combination includes a gas-measuring device with an energy supply module, a display module, an alarm generator module and a sensor module. The modules provide a modular assembly of units that are in functional connection with one another. The safety helmet includes an outer shell and an inner lining. One of the outer shell and the inner lining supports the sensor module to be directed towards the area of a helmet user's mouth or nose.

A user safety process is also provided comprising providing a gas-measuring device comprising an energy supply module, a display module, an alarm generator module and a sensor module, the modules providing a modular assembly of units that are in functional connection with one another and providing a safety helmet comprising an outer shell and an inner lining. The process further includes supporting the sensor module with one of the outer shell and the inner lining such that the sensor module is directed towards the area of a helmet user's mouth or nose.

Provisions are made according to the present invention for the gas-measuring device to be divided into modular components, such as an energy supply module, a display module, an alarm generator module and a sensor module as assembly units that are in functional connection with one another and for the sensor module to be positioned such that the gas concentration is detected and analyzed in the area of the face of the safety helmet user. The helmet user is thus warned in time when the mouth or nose area of the face comes into contact with a toxic gas atmosphere. The alarm generator module, which may comprise both an acoustic alarm and vibration alarm, is arranged preferably in the vicinity of the ears, and the vibration alarm is directly transmitted to the head. It is especially useful to fasten the alarm generator module directly to the inner lining of the safety helmet.

The energy supply module is preferably placed in the middle of the safety helmet in order to achieve a symmetrical weight distribution. The energy supply module is located either directly on the outer shell of the safety helmet or is arranged on the inner lining.

The optical display of the display module may be integrated, for example, in the form of an LCD display area in the safety helmet or a breathing mask attached to the safety helmet. The display module especially preferably has a projection unit, with which measured values or alarm messages can be displayed on a projection surface, for example, a wall or the floor. Due to the projection, both the measured values and alarm messages are displayed in an enlarged form depending on the distance between the projection unit and the projection surface, so that they can be perceived by the user of the safety helmet especially well. As an alternative to a projection unit, it is also possible to use a laser scanner, which writes the measured value on the projection surface located in front of the user. The projection surface may also be located within a breathing mask attached to the safety helmet. Due to the measured value or an alarm massage being projected onto a surface located in front of the user of the helmet, other persons, who are in the vicinity of the helmet user, can also monitor the measured values and take notice of the alarm message.

The sensor module is preferably attached in the area of the helmet user's face. The helmet user is thus reliably warned as soon as toxic gases enter the area of inspiration. This may happen, for example, when the helmet user comes with his or her head into an area loaded with toxic gas, for example, when the helmet user is inspecting a pit or a duct.

An operating module, which comprises a lighting ring and an actuating button located within the lighting ring, is advantageously provided in the lateral area of the safety helmet. The lighting ring is designed such that it can emit light in different wavelength ranges. For example, a blue light indicates that the gas-measuring device is ready to operate. If, by contrast, the lighting ring lights in red, this indicates that the gas concentration has exceeded a limit value. Alarms or status displays can be actuated or reset by the helmet user with the actuating button. The lighting ring is an additional display component, which shows to outsiders whether the gas-measuring device being carried along by the helmet user is ready to operate and whether a state of warning is present at the measured gas concentration.

An LED module extending in a U-shaped pattern is advantageously arranged on the underside of the safety helmet. This LED module comprises a plurality of individual LEDs, which are arranged uniformly distributed on the base surface of the LED module. The LED module is an additional display component, with which alarm or warning states can likewise be displayed.

An exemplary embodiment of the present invention is shown in the Figures and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
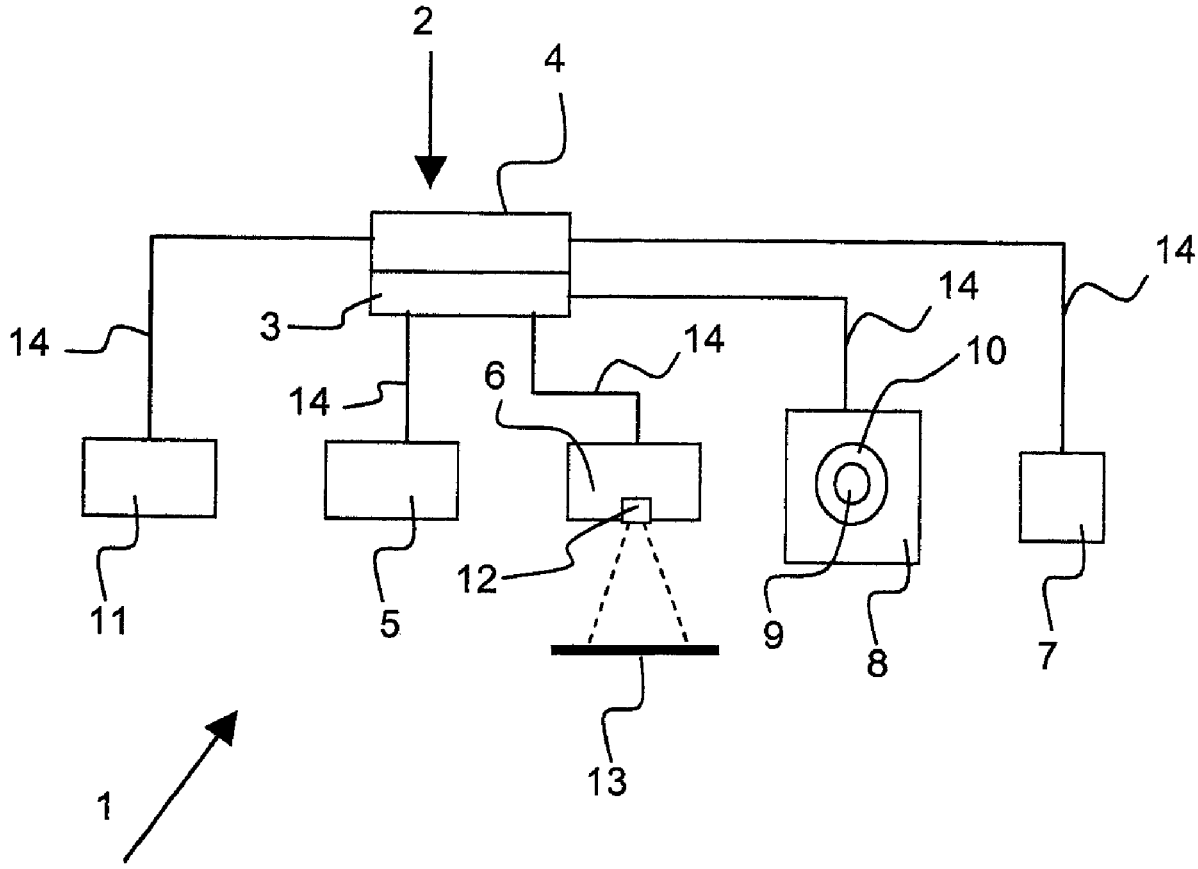
FIG. 1 is a schematic view showing the schematic design of a modular gas-measuring device.

Referring to the drawings in particular, FIG. 1 schematically shows the design of a gas-measuring device 1, which comprises an energy supply module 2, containing an analysis circuit 3 and a battery pack 4, a sensor module 5, a display module 6 and an alarm generator module 7. Furthermore, the gas-measuring device 1 has an operating module 8 with an actuating button 9 and a lighting ring 10 as well as an LED module 11 extending in a horseshoe-shaped pattern on the underside of a safety helmet brim (visor portion), not shown more specifically in FIG. 1.

The display module 6 contains a projection unit 12, which displays measured and status data on a projection surface 13 located in front of the helmet user. Modules 5, 6, 7, 8, 11 are connected to the analysis circuit 3 via signal lines 14.

Figure 2:
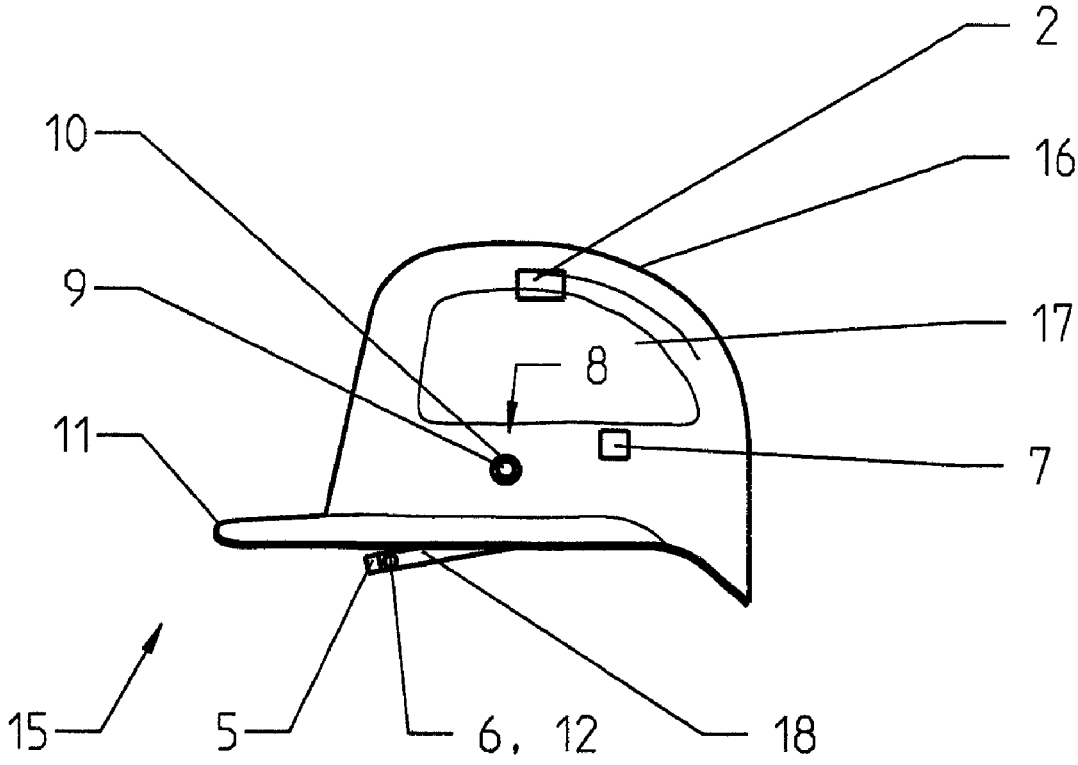
FIG. 2 is a side view of the gas-measuring device according to FIG. 1 on a safety helmet.

FIG. 2 illustrates in a perspective view a safety helmet 15 with an outer shell 16 and an inner lining 17, wherein the sensor module 5 and the display module 6 with the projection unit 12 are attached to an arm 18 arranged laterally on the outer shell 15. The operating module 8 with the actuating button 9 and with the lighting ring 10 arranged around the actuating button 9 is arranged on the lateral surface of the safety helmet 15. The alarm generator module 7 in the form of an acoustic alarm generator with a vibration alarm is likewise arranged in the lateral area. The U-shaped LED module 11 extends on the underside of the safety helmet 15.

The energy supply module 2 is attached on the inside of the outer shell 16 and is located approximately in the middle of the safety helmet 15.

The lighting ring 10 is designed such that displays in different colors are possible. The color red means that a gas concentration limit value has been exceeded. A corresponding warning is sent both via the projection unit 12 and the LED module 11 as well as the alarm generator module 7. The helmet user is thus warned in different ways that a limit value of the gas concentration has been exceeded. If the lighting ring 10 is not backlit, the gas-measuring device 1 is not ready to operate and is switched off. A field lit in light blue shows, by contrast, the standby mode of the gas-measuring device. When the color changes from light blue to green, this means that there is an alarm that is to be acknowledged by pressing the actuating button 9.

Figure 3:
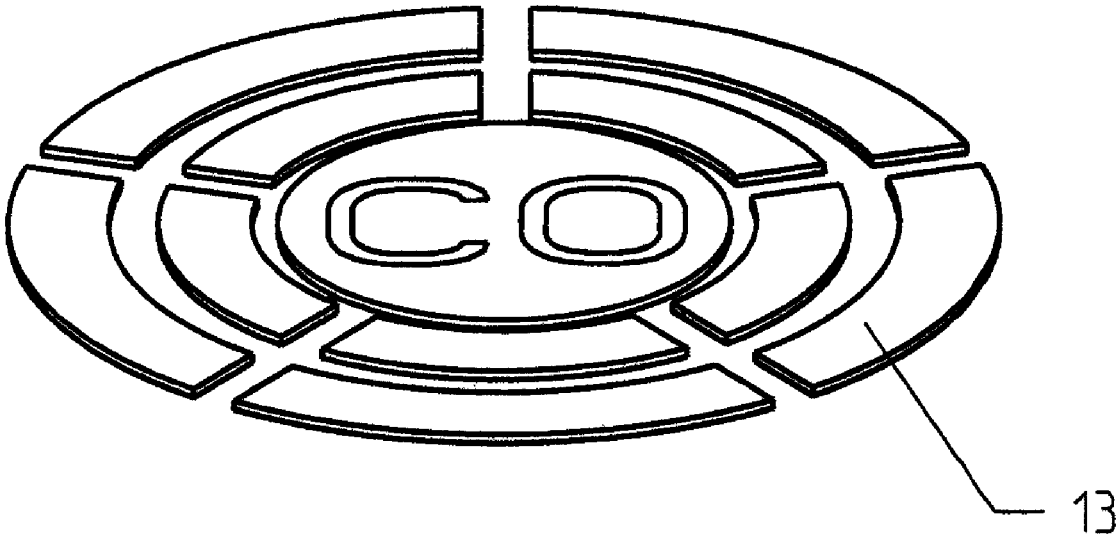
FIG. 3 is a view showing an example of sending an alarm.

FIG. 3 shows an example of a warning message sent by the projection unit 12. The red warning message on the projection surface 13 shows that the limit value for carbon monoxide has been exceeded in this case.

While specific embodiments of the invention have been shown and described in detail to illustrate the application of the principles of the invention, it will be understood that the invention may be embodied otherwise without departing from such principles.

APPENDIX

List of Reference Numbers

1 Gas-measuring device
2 Energy supply module
3 Analysis circuit
4 Battery pack
5 Sensor module
6 Display module
7 Alarm generator module
8 Operating module
9 Actuating button
10 Lighting ring
11 LED module
12 Projection unit
13 Projection surface
14 Signal line
15 Safety helmet
16 Outer shell
17 Inner lining
18 Arm

What is claimed is:

1. A safety helmet with a gas-measuring device combination comprising:
- a gas-measuring device comprising:
  - an energy supply module;
  - a display module;
  - an alarm generator module
  - an operating module with a lighting ring emitting light in different colors for displaying status or alarm states; and
  - a sensor module, the modules providing a modular assembly of units that are in functional connection with one another; and
- a safety helmet comprising:
  - an outer shell; and
  - an inner lining, one of the outer shell and the inner lining supporting the sensor module to be directed towards an area of a helmet user's mouth or nose.

2. A device combination in accordance with claim 1, wherein the display module comprises a projection unit for outputting a projected display of measured or status data onto a projection surface.

3. A device combination in accordance with claim 1, wherein an LED module extending in a U-shaped pattern is present on an underside of the safety helmet.

4. A device combination in accordance with claim 3, wherein the LED module is provided for displaying an alarm or warning state.

5. A device combination in accordance with claim 1, wherein the alarm generator module comprises an acoustic alarm generator or a vibration alarm.

6. A user safety process comprising:

providing a gas-measuring device comprising an energy supply module, a display module, an alarm generator module and a sensor module, the modules providing a modular assembly of units that are in functional connection with one another;

providing a safety helmet comprising an outer shell, an underside and an inner lining;

supporting the sensor module with one of the outer shell and the inner lining such that the sensor module is directed towards the area of a helmet user's mouth or nose;

providing an LED module in a U-shaped pattern extending on said underside of the safety helmet.

7. A user safety process in accordance with claim 6, wherein the display module comprises a projection unit and further comprising outputting a projected display of measured or status data onto a projection surface.

8. A user safety process in accordance with claim 6, wherein the gas-measuring device comprises an operating module with a lighting ring and further comprising emitting light in different colors from the lighting ring for displaying status or alarm states.

9. A user safety process in accordance with claim 6, wherein the LED module is provided for displaying an alarm or warning state.

10. A user safety process in accordance with claim 7, wherein the alarm generator module comprises an acoustic alarm generator or a vibration alarm.

11. A safety helmet comprising:

an outer shell;

an inner lining, said inner lining cooperating with said outer shell to form a user's head receiving region, said user's head receiving region determining a position of an area of a helmet user's mouth and nose relative to the outer shell and inner shell;

an energy supply module;

a display module;

an alarm generator module;

a sensor module, the modules providing a modular assembly of units that are in functional connection with one another and connected to said outer shell with one of the outer shell and the inner lining supporting the sensor module to direct the sensor module towards the area of the helmet user's mouth or nose; and an operating module with a lighting ring emitting light in different colors for displaying status or alarm states.

12. A safety helmet in accordance with claim 11, wherein the display module comprises a projection unit for outputting a projected display of measured or status data onto a projection surface.

13. A safety helmet in accordance with claim 11, wherein an LED module extending in a U-shaped pattern is present on an underside of the safety helmet.

14. A safety helmet in accordance with claim 13, wherein the LED module is provided for displaying an alarm or warning state.

15. A safety helmet in accordance with claim 11, wherein the alarm generator module comprises an acoustic alarm generator or a vibration alarm.

16. A safety helmet with a gas-measuring device combination comprising:

a gas-measuring device comprising:

an energy supply module;

a display module;

an alarm generator module; and a sensor module, the modules providing a modular assembly of units that are in functional connection with one another; and a safety helmet comprising:

an outer shell; and an inner lining, one of the outer shell and the inner lining supporting the sensor module to be directed towards an area of a helmet user's mouth or nose, wherein an LED module extending in a U-shaped pattern is present on an underside of the safety helmet.

17. A safety helmet comprising:

an outer shell;

an inner lining, said inner lining cooperating with said outer shell to form a user's head receiving region, said user's head receiving region determining a position of an area of a helmet user's mouth and nose relative to the outer shell and inner shell;

an energy supply module;

a display module;

an alarm generator module; and a sensor module, the modules providing a modular assembly of units that are in functional connection with one another and connected to said outer shell with one of the outer shell and the inner lining supporting the sensor module to direct the sensor module towards the area of the helmet user's mouth or nose, wherein an LED module extending in a U-shaped pattern is present on an underside of the safety helmet.

* * * * *